US006321623B1

(12) United States Patent
Dykes et al.

(10) Patent No.: US 6,321,623 B1
(45) Date of Patent: Nov. 27, 2001

(54) JAM-PROOF AND TAMPER-RESISTANT LUG NUT

(75) Inventors: James R. Dykes, Savannah, GA (US); Scott Hicklin, New Market, AL (US)

(73) Assignee: The Jendyk Company, Inc., Savannah, GA (US)

( * ) Notice: Subject to any disclaimer, the term of this patent is extended or adjusted under 35 U.S.C. 154(b) by 0 days.

(21) Appl. No.: 09/426,964

(22) Filed: Oct. 26, 1999

(51) Int. Cl.[7] ..... B25B 13/06
(52) U.S. Cl. ..... 81/121.1; 411/402
(58) Field of Search ..... 81/121.1, 124.6, 81/186; 411/402, 405, 410, 427, 429, 432, 910, 919

(56) References Cited

U.S. PATENT DOCUMENTS

| | | | | |
|---|---|---|---|---|
| 1,447,564 | | 3/1923 | Norlund et al. . | |
| 1,543,175 | | 6/1925 | McCarthy . | |
| 1,794,564 | | 3/1931 | White . | |
| 3,874,258 | | 4/1975 | Semola et al. . | |
| 3,908,489 | * | 9/1975 | Yamamoto et al. | 81/121.1 |
| 3,969,974 | * | 7/1976 | Lejdegard | 85/45 |
| 4,006,660 | * | 2/1977 | Yamamoto et al. | 85/45 |
| 4,269,248 | * | 5/1981 | MacLean et al. | 411/186 |
| 4,616,535 | | 10/1986 | Chiavon . | |
| 5,137,407 | * | 8/1992 | Yamamoto | 411/404 |
| 5,265,503 | | 11/1993 | Dolin . | |
| 5,271,299 | | 12/1993 | Wadsworth . | |
| 5,324,149 | * | 6/1994 | Bainbridge et al. | 411/431 |
| 5,452,944 | | 9/1995 | Bear . | |
| 5,628,602 | * | 5/1997 | Ohsawa | 411/405 |
| 5,682,801 | * | 11/1997 | Waechter | 81/121.1 |
| 5,884,980 | | 3/1999 | Visser et al. . | |
| 6,045,311 | * | 4/2000 | Chang | 411/402 |

* cited by examiner

*Primary Examiner*—Joseph J. Hail, III
*Assistant Examiner*—David B. Thomas
(74) *Attorney, Agent, or Firm*—Dority & Manning, PA

(57) ABSTRACT

A jam-proof, tamper resistant lug nut is disclosed for holding a tire rim on a bolt extending from an axle mount. The lug nut comprises a tapered main body with a plurality of rounded, raised wrench engaging surfaces. The main body of the nut includes a proximal end, which abuts against the wheel mounting surface, and a distal end. A threaded hole extends from the proximal end toward the distal end along a longitudinal axis defined by the hole. The main body is further tapered and includes a star-shaped exterior section which decreases in size along the axis toward the distal end.

10 Claims, 5 Drawing Sheets

Fig. 1
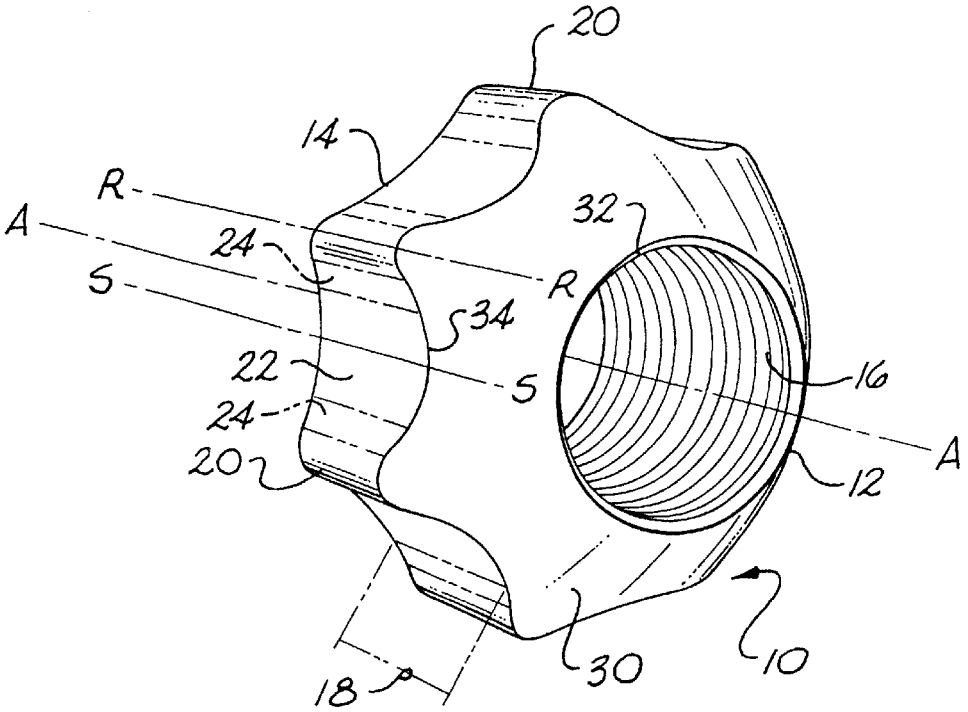
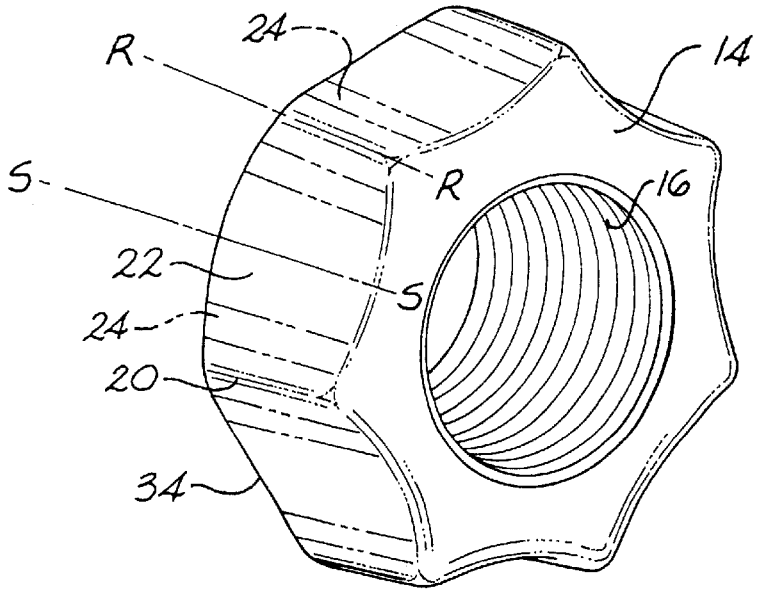
Fig. 2

Fig. 5
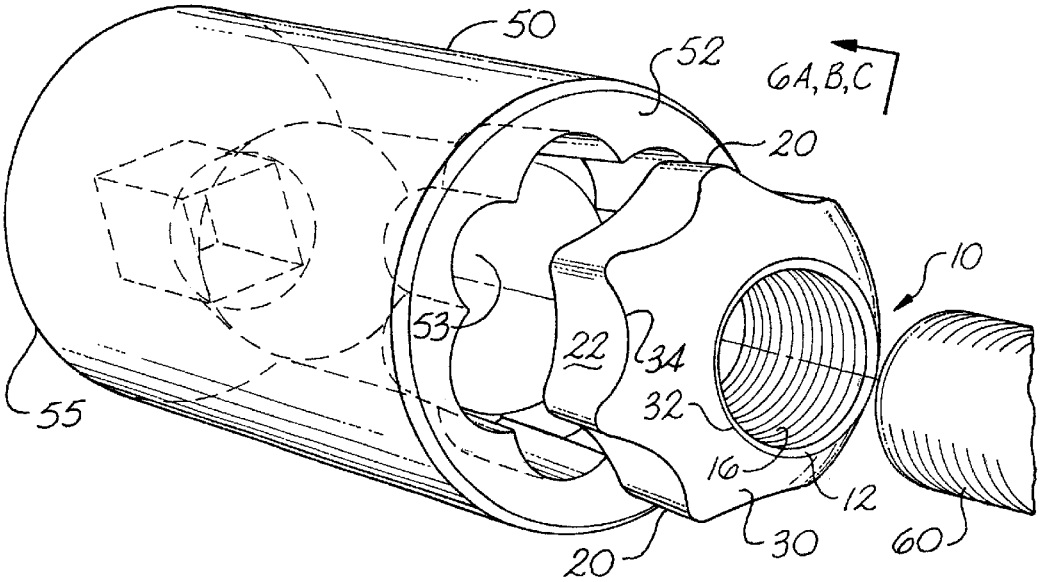
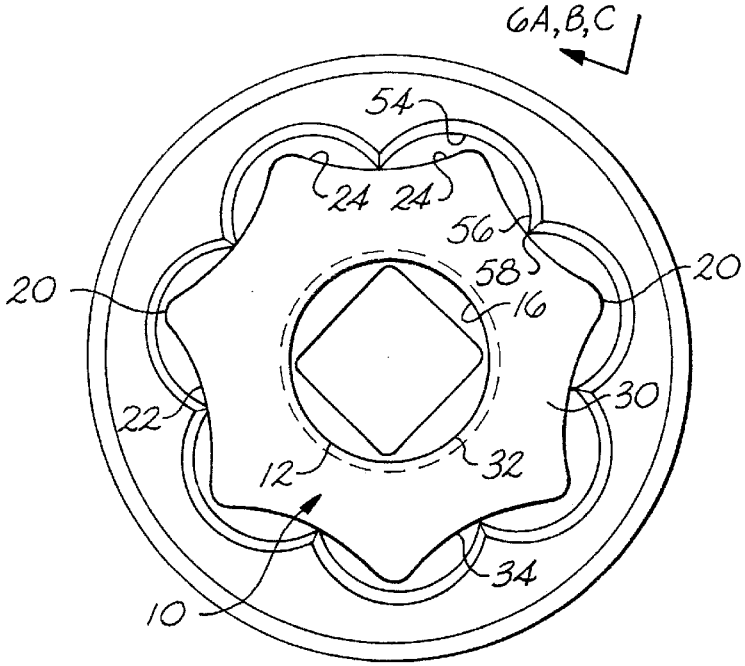
Fig. 6A

JAM-PROOF AND TAMPER-RESISTANT LUG NUT

FIELD OF THE INVENTION

This invention is directed towards a fastening device and, more specifically, for a lug nut for holding a wheel on a vehicle axle.

BACKGROUND OF THE INVENTION

Lug nuts are commonly used for mounting and holding a tire on a vehicle. The nuts are installed or removed either with a manual tire wrench or a power-driven socket wrench. Typical lug nuts are hexagonal in shape and employ a correspondingly shaped mated socket for attaching and removing the lug nuts.

Within the field of automobile racing, periodic pit stops are required during the race to allow for refueling and changing of the vehicle's tires. The duration of a pit stop may be of critical importance. As such, time is of the essence as a typical pit crew tries to refuel a vehicle and change all four vehicle tires within a 15–20 second time window. To accomplish this as rapidly as possible, power socket wrenches are used to remove and secure the lug nuts. The typical lug nut used on the automotive racing circuit is sized to fit the dimensions of a mated socket wrench. If the lug nut is improperly positioned within the socket, the lug nut may be ejected from the socket as the socket wrench is rotated. Further, the alignment of the lug nut to the mated socket can be time consuming since tight tolerances exist between a typical lug nut and socket. Such delays are costly in terms of the duration of the pit stop.

One technique commonly used by a pit crew is to fasten the lug nuts over the openings in a spare tire prior to a pit stop so that the pit crew is not required to manually place the lug nuts on the studs of the wheel hub. To accomplish this, an adhesive material, such as a caulking product or adhesive tab, is used to position the lug nuts in position opposite the mounting bores defined by the wheel. Once positioned, the wheel, having the pre-aligned lug nuts positioned over the mounting bores, is ready for immediate mounting onto the wheel hub.

In the context of a race car pit stop, the socket wrench is typically rotating prior to contacting the lug nut. At times, the lug nut will become jammed within the socket, particularly if the lug nut is engaged at a slight angle. In other instances, while the lug nut may not jam within the socket, the rotating socket will contact the lug nut in such a manner that the lug nut will fly off in various directions. In either instance, the delay results in an extended pit stop, thereby increasing the difficulty of running a competitive race.

Accordingly, there is a need for an improved nut/socket wrench combination which will alleviate the jamming of a lug nut within the socket and decrease the loss of a lug nut during installation.

SUMMARY OF THE INVENTION

One embodiment of the present invention is a lug nut for holding a tire rim on a bolt extending from an axle mount. The lug nut comprises a tapered main body with a plurality of rounded, raised wrench engaging surfaces. The main body of the nut includes a proximal end which abuts against the wheel mounting surface and a distal end. A threaded hole extends from the proximal end toward the distal end along a longitudinal axis defined by the hole. The main body is further tapered and includes a star-shaped exterior section which decreases in size along the axis toward the distal end.

Another embodiment of the present invention is a lug nut wrench and lug nut combination adapted for engaging the nut described above. A wrench is provided having interior surfaces defining a socket for receiving the lug nut. The interior surface of the wrench contacts a star-shaped exterior of the lug nut along a portion of a curved shoulder defined alongside a series of spaced terminal ridges. The curved shoulder adjacent each raised ridge provides a contact surface for the engaging surfaces of the wrench. The overall taper of the lug nut allows an initially misaligned wrench sufficient play such that the operator may rock the wrench socket relative to the lug nut so as to prevent jamming and to complete the insertion or removal of the lug nut from the bolt.

An additional object of the present invention is to provide a lug nut which deters theft. The present invention requires a specialized mated tool to remove a tightened lug nut. Accordingly, the present invention is useful for vehicle tires, and particularly for externally mounted spare tires which are susceptible to theft. In particular, car dealers have a need for a tamper-resistant lug nut which may be used to secure exterior spare tires, as such tires are prone to theft off the dealer's lot.

These and other features, aspects and advantages of the present invention will become better understood with reference to the following description and appended claims.

BRIEF DESCRIPTION OF THE DRAWINGS

FIG. 1 is a front perspective view of a proximal end of a lug nut according to the present invention;

FIG. 2 is a perspective view of the distal end of the lug nut seen in FIG. 1;

FIG. 5 is an exploded perspective view in partial phantom illustrating the lug nut in relation to a mounting stud and mated socket;

FIGS. 6A–6C are views seen along the direction of reference line 6A, 6B, 6C seen in FIG. 5.

DESCRIPTION OF THE PREFERRED EMBODIMENT

Figure 3:
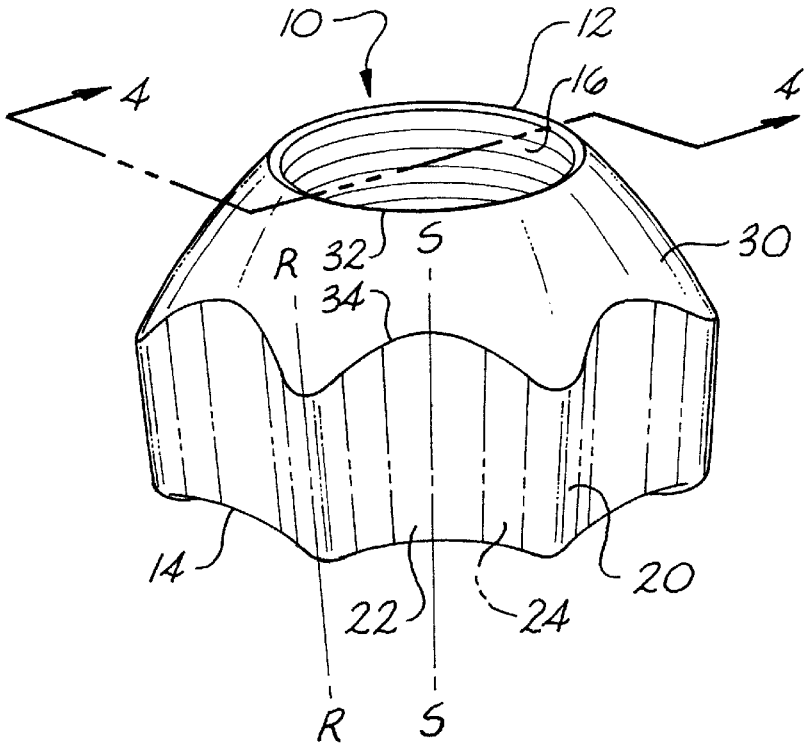
FIG. 3 is a side perspective view of the lug nut seen in FIG. 1.
Figure 4:
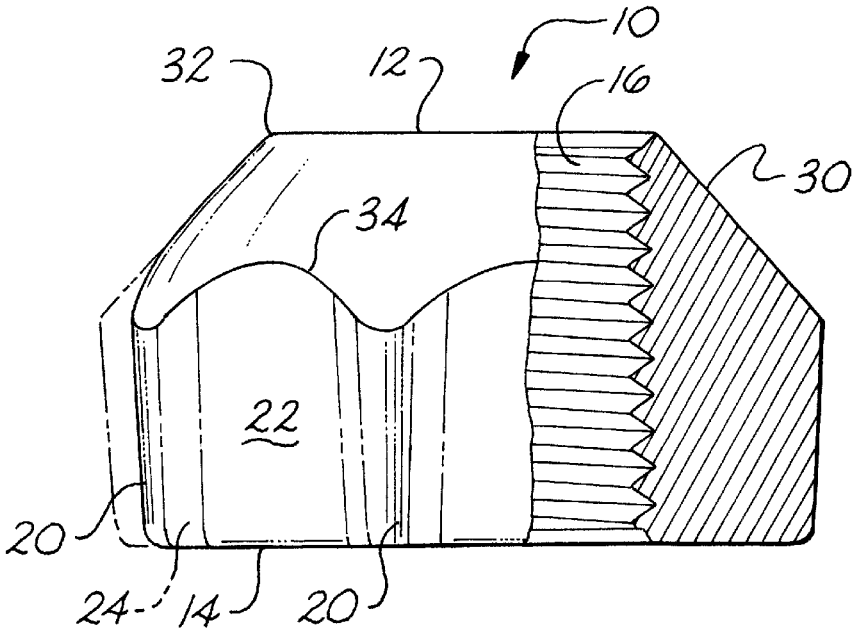
FIG. 4 is a side plan view in partial section of the lug nut seen in FIGS. 1–3.

Reference now will be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents. Other objects, features, and aspects of the present invention are disclosed in, or are obvious from, the following detailed description. It is to be understood by one of ordinary skill in the art that the present discussion is a description of exemplary embodiments only and is not intended as limiting the broader aspects of the present invention, which broader aspects are embodied in the exemplary constructions.

In general, the present invention relates to an improved lug nut which permits the rapid installation and removal of a lug nut from a wheel. While a preferred embodiment of the invention is discussed in the context of an automotive racing environment, the present invention is applicable to use with other automotive uses, including all types of passenger cars, trucks, as well as commercial vehicles such as 18-wheelers. Further, the present invention is useful as an anti-theft device in that standard wrenches cannot be used in the removal of the lug nuts.

As seen in FIGS. 1–4, one embodiment of the invention is shown. The lug nut 10 has a proximal end 12, a distal end 14, and defines a threaded bore 16 along an axis "A" which extends the length of the lug nut 10. A midsegment 18 is defined between the opposing ends 12 and 14 and further defines a plurality of raised ridges 20 along an exterior surface. Each ridge 20 is connected to a similar adjacent ridge through a subtending curved wall segment 22 which provides a convex curvature position between each ridge 20. A pair of shoulders 24 is further defined along either side of each ridge 20 and forming a portion of wall 22. Shoulder 24 is an engagement surface by which a correspondingly mated socket (FIGS. 6B and 6C) is used to apply rotational forces to the lug nut 10.

Proximal end 12 has an outer frustum surface 30 (i.e., a truncated cone) in which the surface taper extends outwardly from the proximal end, terminating in a starlike pattern and in conformity with the curvature pattern of the proximal end of midsegment 18. Frustum surface 30 has a first proximal end which defines an aperture 32 in communication with bore 16. Frustum surface 30 further defines a distal end 34 which has a repeating curvature pattern which terminates opposite the curved edges associated with the proximal end of midsegment 18.

In other words, a length of surface 18, as seen along a reference line R—R of FIGS. 1–3 and which extends along the length of a raised ridge 20, is less than a length of surface 18 as measured along reference line S—S (FIG. 1). The curved boundary between the frustum surface 30 and the proximal end of midsegment 18 defines a repeating scalloped pattern corresponding to where the curved wall segments 22 and ridges 20 intersect the frustum surface 30.

The outer surface of the lug nut may define an odd number of ridges 20 where the odd number of ridges is greater than or equal to three. In the illustrated embodiment, seven ridges 20 are provided, though this number is not believed critical to the practicing of the invention.

The lug nut is designed to receive a wheel bolt 60 from the proximal direction (FIG. 5). Once engaged, the frustum surface aperture 32 engages the metal wheel surface. When installed on a wheel lug, the distal end 14 of lug nut 10 extends from the wheel and provides a geometric pattern having seven star-like projections interconnected by generally U-shaped scallops. Distal end 14 terminates in a substantially flush surface. As best seen in reference to FIG. 7, the midsegment 18 defines a uniform taper of between 1–5 degrees and more preferably defines a taper of approximately 4 degrees such that the circumferential length of the distal end of midsegment 18 (i.e., the distal end 14 of lug nut 10) is less than the circumferential distance of the proximal end of midsegment 18. Further, with respect to any given plane of the lug nut perpendicular to the central axis, the outer diameter of the lug nut remains constant.

Figure 6B:
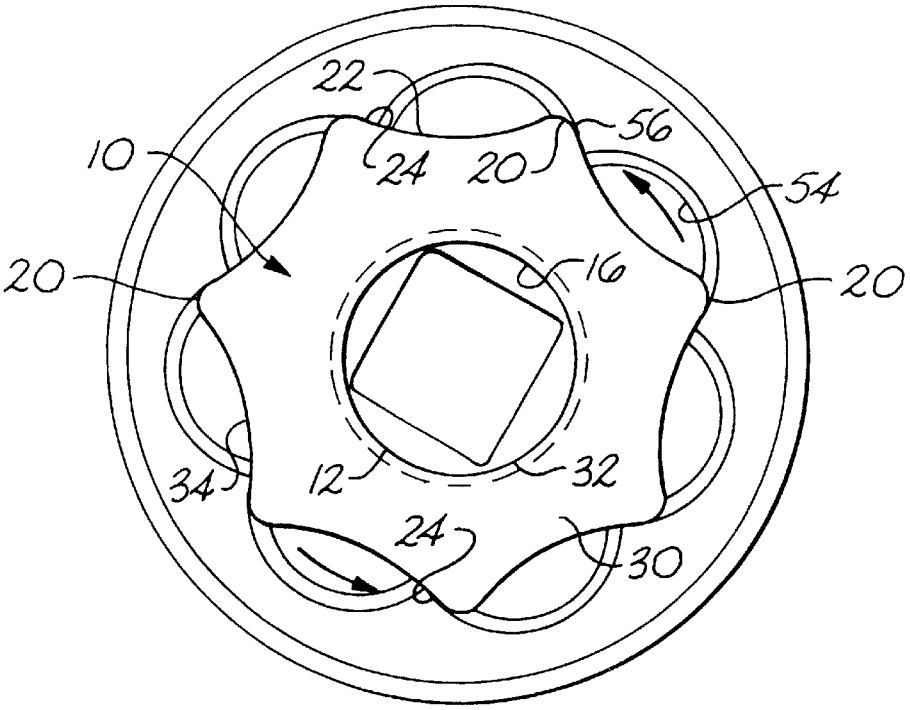
Figure 6C:
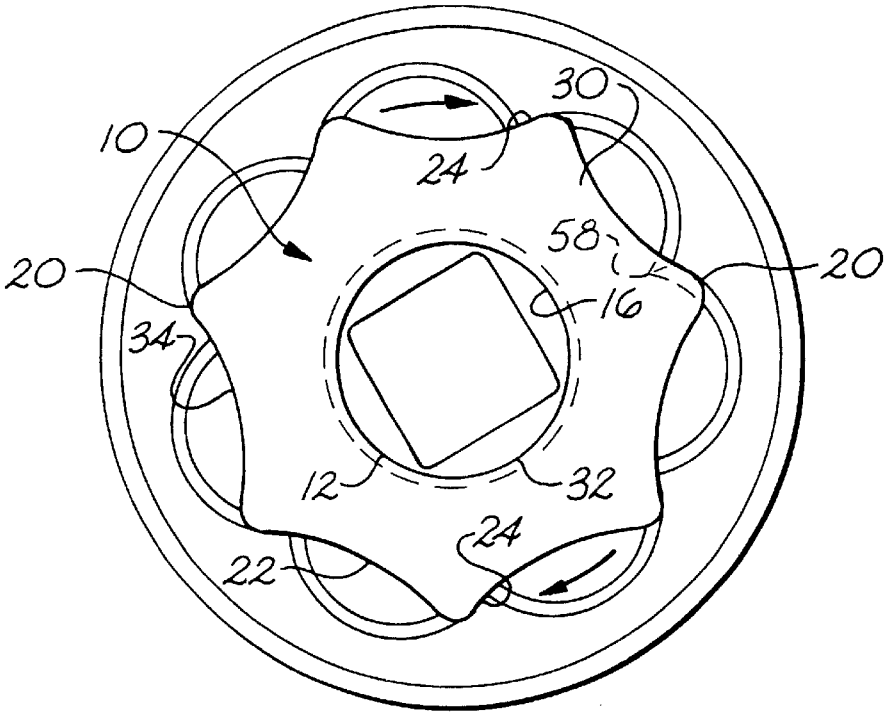
Figure 7:
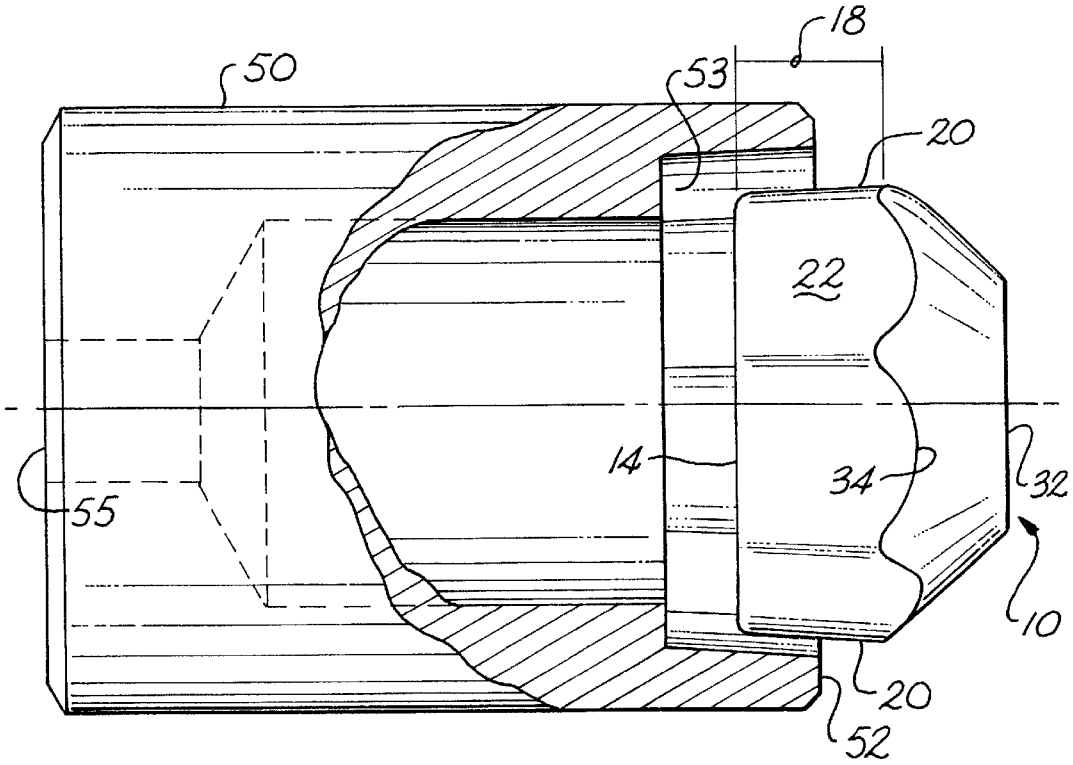
FIG. 7 is a side view in partial section of the lug nut and mated socket setting forth additional details of the invention.

The smaller circumference/diameter on the distal end, along with the constant diameter for a perpendicular plane, facilitates the placement of a mated socket such as the socket 50 seen in FIGS. 5–7. Socket 50 defines a cylinder having an exterior surface and an interior surface. A proximal end 52 defines a chamber 53 having a plurality of interior arcuate walls 54. Each wall 54 defines a pair of terminal wall ends 56. Adjacent end walls 56 collectively define a raised ridge member 58. Since the outer diameter along any single plane perpendicular to the longitudinal axis of the lug nut remains constant, a mated socket may have a complementary-shaped receptacle. Accordingly, receptacle 53 of socket 50 defines an inner diameter along any single plane perpendicular to a longitudinal axis of the socket, which remains a constant diameter length. As a result, the flared proximal end of socket 50 can initially engage the lug nut over a wider range of presentation angles and alignment offsets. As the socket further engages the nut, the integral and cooperative ridges and curved walls provide for a self-guiding and alignment mechanism between the socket chamber and the lug nut.

The open, proximal end of chamber 53 has a larger diameter than the interior distal end of chamber 53. In operation, the chamber 53 is sized to engage the exterior surface of nut 10. As best seen in reference to FIGS. 6A–6C, when chamber 53 engages the midsegment 18 of nut 10, each raised ridge 58 of chamber 53 is opposite the subtending curved wall segment 22. Correspondingly, this position places the socket's interior arcuate wall 54 opposite the raised ridges 20 of lug nut 10. Further, the taper and direction defined by the exterior surface of midsegment 18 is matched by a corresponding taper of the socket chamber 53.

When a rotational force is provided to the socket positioned on the lug nut, as seen in reference to directional arrows in FIGS. 6B and 6C, each socket ridge 58 engages a single shoulder 24 along each lug nut ridge 20. This arrangement provides a contact point between ridge 58 and shoulder 24, which is below the highest point defined by ridge 20. As a result, the outer surface of the lug nut resists stripping, which is a reoccurring problem with traditional flat surface, polygonal-shaped lug nuts.

When the rotational force is removed from the socket, the socket is allowed to "relax" (FIG. 6A) relative to the lug nut, in that the socket ridges 58 no longer engage the lug nut shoulders 24. Rather, the socket ridges 58 rest within the subtending curved wall segment 22. The resulting play permitted between the socket and the lug nut facilitates the removal of the socket from a tightened lug nut. Further, the play facilitates the release of a free lug nut from the socket. Further, the play between the socket and the lug nut also allows for heat-induced expansion of the lug nut. The amount of play allows the socket and lug nut to operate irrespective of changes associated with thermal expansion.

Accordingly, since the socket chamber 53 is slightly oversized with respect to the distal end 14 of nut 10, a precise alignment between the nut and the socket is not required for the initial engagement between the socket and the nut. Thereafter, the respective tapers and interaction between the interengaging ridges and curved wall structures provides a self-aligning feature as the socket further engages the nut.

The distal end 55 of socket 50 is adapted for receiving a standard one-quarter or three-eighths pneumatic drive within a drive sleeve 57. However, other conventional drive mechanisms, including manual ratchets, may be used to engage the socket drive sleeve.

The present invention provides several advantages over traditional lug nuts. One, the taper facilitates the rapid engagement by the drive socket. In the race car pit environment, a pneumatic driven socket is often still rotating when the socket first makes contact with a lug nut engaging a wheel. The tapered, smaller diameter distal end of the lug nut is more easily engaged by the socket 50 and allows lateral movement and play between the socket 50 and lug nut 10. Even when fully engaged, a certain amount of play is present between the socket and the lug nut which prevents binding of the removed lug nut within the socket. This anti-binding feature is important in that it avoids jammed lug nuts within a socket. A jammed lug nut entails a costly time delay in a pit stop. The amount of play between the lug nut and the socket allows the nut to tumble freely from the socket when the socket is directed towards the ground. Should lug nut 10 become damaged from track debris or other impact, the amount of play which exists between the lug nut 10 and the engaging socket 50 will still permit engagement and rotation of a lug nut having an altered surface profile. This feature is an improvement over the tight tolerances of a traditional flat surface, polygonal-shaped lug nut which, if damaged, may not engage a close-fitting socket.

An additional advantage of the present lug nut is provided by the frustum surface 30 which provides an engaging surface for the wheel. If desired, the wheel may include an appropriate shaped counter-sunk wheel bore to provide a more aerodynamic profile for the now recessed lug nut. Alternatively, the lug nut 10 may engage a flat wheel surface. An advantage of the latter arrangement is that the reduced contact area between the proximal end of the lug nut and the wheel surface is that the reduced contact area makes it easier to break torque when removing the lug nut. This feature is useful for applications where manual installation or removal of a socket is needed.

A further feature of the present invention is that the lug nut is not readily removed with conventional tools. Accordingly, a wheel or externally mounted spare tire having one or more lug nuts 10 securing the wheel will deter theft. It is envisioned that a car dealer can use the lugs on car and truck inventory to prevent the theft of the wheels and tires. Upon sale of the vehicle, the dealer may then replace the standard lugs which originally came with the vehicle.

Although preferred embodiments of the invention have been described using specific terms, devices, and methods, such description is for illustrative purposes only. The words used are words of description rather than of limitation. It is to be understood that changes and variations may be made by those of ordinary skill in the art without departing from the spirit or the scope of the present invention, which is set forth in the following claims. In addition, it should be understood that aspects of the various embodiments may be interchanged, both in whole or in part. Therefore, the spirit and scope of the appended claims should not be limited to the description of the preferred versions contained therein.

What is claimed is:

1. A lug nut for securing a wheel to a vehicle axle bolt comprising:

a lug nut having a proximal end and a distal end, the lug nut defining a threaded hole for receiving a bolt, the threaded hole extending along a longitudinal axis of the nut between the proximal end and the distal end;

an outer perimeter of the proximal end defining a tapered, conical surface, the tapered surface diverging outwardly from the proximal end and defining a terminal portion along a midsegment of the lug nut exterior;

the midsegment of the nut having a perimeter surface defining a plurality of ridges, each one of the plurality of ridges being connected to an adjacent ridge by an interconnected concave surface, the perimeter surface decreasing in size from a proximal end to a distal end of the lug nut said distal end being flush with respect to said ridges and said interconnecting concave surfaces; and, each ridge opposite one of said concave surfaces, an axial length of each said concave surface being greater than an axial length of each of said ridges.

2. A lug nut for securing a wheel to a vehicle axle bolt comprising:

a lug nut having a proximal end and a distal end, the lug nut defining a threaded hole for securing a bolt, the threaded hole extending along a longitudinal axis of the nut between the proximal end and the distal end;

an outer engaging surface of the distal end of said lug nut defining a series of ridges, each ridge connected to an adjacent ridge by an intervening curved wall segment each ridge opposite one of said curved wall segments, said plurality of ridges in said arcuate walls defining a terminus along said distal end, said terminus being co-planar with respect to a plane perpendicular to said longitudinal axis;

a proximal end of the lug nut defining a conical shaped outer surface which defines a taper along the axis toward the proximal end; and, said outer engaging surface defining an outer perimeter which decreases in size along the axis toward the distal end.

3. A lug nut for securing a wheel to a bolt comprising:

a lug nut having a proximal end and a distal end, the lug nut defining a threaded hole for securing a bolt, the threaded hole extending along a longitudinal axis of the nut between the proximal end and the distal end; and, an outer engaging surface of the lug nut defining a plurality of raised ridges, each of said plurality of ridges being spaced opposite an arcuate wall, each of said plurality of ridges further defining a longitudinal length less than a longitudinal length of said opposite arcuate wall, a distal end of said plurality of ridges and said arcuate walls being co-planar with respect to a plane perpendicular to said longitudinal axis.

4. The lug nut according to claim 3 wherein the outer engaging surface of the lug nut defines a longitudinal taper of between about 1 and 5 degrees.

5. The lug nut according to claim 4 wherein the taper is substantially about 4 degrees.

6. The lug nut according to claim 3 wherein the distal end of the lug nut defines a circumference less than a circumference of the axially opposite portion of the outer engaging surface.

7. The lug nut according to claim 3 wherein the proximal end of the lug nut defines a conical outer surface.

8. The lug nut according to claim 3 wherein the outer engaging surface of the lug nut defines seven (7) ridges.

9. The lug nut according to claim 3 wherein the outer engaging surface of the lug nut defines an odd number of ridges.

10. A lug nut and lug nut wrench jam-proof combination for attaching a wheel to a bolt comprising:

a lug nut having a proximal end and a distal end, the lug nut defining a threaded hole for receiving a bolt, the threaded hole extending along a longitudinal axis of the nut between the proximal end and the distal end;

a midsegment of the nut having a perimeter surface defining a plurality of ridges, each one of the plurality of ridges being connected to an adjacent ridge by an interconnected concave surface each one of said plurality of ridges spaced opposite a respective one of said interconnected concave surfaces, said distal end being flush with respect to said ridges and said interconnecting concave surfaces; and a wrench having interior surfaces defining a socket for receiving said lug nut with the wrench having an axis of rotation extending centrally through the socket, the interior surfaces comprising a plurality of ridges, each one of the plurality of the ridges being connected to an adjacent ridge by an interconnected concave surface wherein the socket ridges interengage with the lug nut concave surfaces, thereby providing opposing surfaces when the socket rotates the lug nut.

* * * * *